US010477322B2

(12) United States Patent
Khenkin et al.

(10) Patent No.: US 10,477,322 B2
(45) Date of Patent: Nov. 12, 2019

(54) MEMS DEVICE AND PROCESS

(71) Applicant: Cirrus Logic International Semiconductor Ltd., Edinburgh (GB)

(72) Inventors: Aleksey Sergeyevich Khenkin, Nashua, NH (US); Tsjerk Hans Hoekstra, Balerno (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/708,822

(22) Filed: Sep. 19, 2017

(65) Prior Publication Data

US 2018/0091906 A1 Mar. 29, 2018

Related U.S. Application Data

(60) Provisional application No. 62/399,559, filed on Sep. 26, 2016.

(30) Foreign Application Priority Data

Oct. 31, 2016 (GB) ..... 1618354.3

(51) Int. Cl.

| | |
|---|---|
| ***H04R 19/04*** | (2006.01) |
| ***H04R 19/00*** | (2006.01) |
| ***H04R 31/00*** | (2006.01) |
| ***H04R 1/04*** | (2006.01) |

(52) U.S. Cl.

CPC ..... *H04R 19/04* (2013.01); *H04R 19/005* (2013.01); *H04R 31/003* (2013.01); *H04R 1/04* (2013.01); *H04R 2201/003* (2013.01); *H04R 2410/01* (2013.01); *H04R 2410/03* (2013.01)

(58) Field of Classification Search

CPC .... H04R 19/04; H04R 19/005; H04R 31/003; H04R 1/04

See application file for complete search history.

(56) References Cited

U.S. PATENT DOCUMENTS

| | | | | |
|---|---|---|---|---|
| 6,075,867 | A | 6/2000 | Bay et al. | |
| 6,358,021 | B1 | 3/2002 | Cabuz | |
| 2002/0043895 | A1 | 4/2002 | Richards et al. | |
| 2006/0267109 | A1 * | 11/2006 | Ohguro ..... | B81C 1/00333 257/396 |

(Continued)

FOREIGN PATENT DOCUMENTS

| | | | |
|---|---|---|---|
| CN | 103888888 | A | 6/2014 |
| CN | 104581585 | A | 4/2015 |

(Continued)

OTHER PUBLICATIONS

Combined Search and Examination Report under Sections 17 and 18(3), UKIPO, Application No. GB1618354.3, dated Mar. 10, 2017.

(Continued)

*Primary Examiner* — Sunita Joshi

(74) *Attorney, Agent, or Firm* — Jackson Walker L.L.P.

(57) ABSTRACT

The application describes a MEMS transducer comprising: a substrate; a primary membrane supported in a fixed relation relative to the substrate and a secondary membrane provided in a plane overlying the primary membrane. The secondary membrane is mechanically coupled to the primary membrane by a substantially rigid coupling structure. A rigid support plate may be interposed between the primary and secondary membranes.

21 Claims, 11 Drawing Sheets

(56) References Cited

U.S. PATENT DOCUMENTS

| | | | | |
|---|---|---|---|---|
| 2007/0201710 | A1* | 8/2007 | Suzuki | B81B 3/0072 381/174 |
| 2011/0311081 | A1 | 12/2011 | Kim | |
| 2015/0251899 | A1 | 9/2015 | Dehe et al. | |
| 2015/0256913 | A1* | 9/2015 | Dehe | H04R 1/08 381/176 |
| 2015/0256940 | A1 | 9/2015 | Dehe et al. | |
| 2016/0066099 | A1* | 3/2016 | Dehe | B81B 3/0021 381/174 |

FOREIGN PATENT DOCUMENTS

| | | | |
|---|---|---|---|
| EP | 2145696 | A1 | 1/2010 |
| KR | 2003-0075906 | | 9/2003 |
| WO | 2013021235 | A1 | 2/2013 |

OTHER PUBLICATIONS

Combined Search and Examination Report under Sections 17 and 18(3), UKIPO, Application No. GB1618354.3, dated Apr. 6, 2017.
Examination Opinion of the Taiwan Intellectual Property Office, Application No. 106131811, dated Oct. 29, 2018.
First Office Action of the China National Intellectual Property Administration, Application No. 2017108822614, dated Jul. 31, 2019.

* cited by examiner

MEMS DEVICE AND PROCESS

FIELD OF DISCLOSURE

The present disclosure relates to a micro-electro-mechanical system (MEMS) device and process, and in particular to a MEMS device and process relating to a transducer, for example a capacitive microphone.

BACKGROUND

Various MEMS devices are becoming increasingly popular. MEMS transducers, and especially MEMS capacitive microphones, are increasingly being used in portable electronic devices such as mobile telephones and portable computing devices.

Microphone devices formed using MEMS fabrication processes typically comprise one or more membranes with electrodes for read-out/drive deposited on the membranes and/or a substrate. In the case of MEMS pressure sensors and microphones, the read out is usually accomplished by measuring the capacitance between a pair of electrodes which will vary as the distance between the electrodes changes in response to sound waves incident on the membrane surface.

FIGS. 1*a* and 1*b* show a schematic diagram and a perspective view, respectively, of a known capacitive MEMS microphone device 100. The capacitive microphone device 100 comprises a membrane layer 101 which forms a flexible membrane which is free to move in response to pressure differences generated by sound waves. A first electrode 102 is mechanically coupled to the flexible membrane, and together they form a first capacitive plate of the capacitive microphone device. A second electrode 103 is mechanically coupled to a generally rigid structural layer or back-plate 104, which together form a second capacitive plate of the capacitive microphone device. In the example shown in FIG. 1*a* the second electrode 103 is embedded within the back-plate structure 104.

The capacitive microphone is formed on a substrate 105, for example a silicon wafer which may have upper and lower oxide layers 106, 107 formed thereon. A cavity 108 in the substrate and in any overlying layers (hereinafter referred to as a substrate cavity) is provided below the membrane, and may be formed using a "back-etch" through the substrate 105. The substrate cavity 108 connects to a first cavity 109 located directly below the membrane. These cavities 108 and 109 may collectively provide an acoustic volume thus allowing movement of the membrane in response to an acoustic stimulus. Interposed between the first and second electrodes 102 and 103 is a second cavity 110.

The first cavity 109 may be formed using a first sacrificial layer during the fabrication process, i.e. using a material to define the first cavity which can subsequently be removed, and depositing the membrane layer 101 over the first sacrificial material. Formation of the first cavity 109 using a sacrificial layer means that the etching of the substrate cavity 108 does not play any part in defining the diameter of the membrane. Instead, the diameter of the membrane is defined by the diameter of the first cavity 109 (which in turn is defined by the diameter of the first sacrificial layer) in combination with the diameter of the second cavity 110 (which in turn may be defined by the diameter of a second sacrificial layer). The diameter of the first cavity 109 formed using the first sacrificial layer can be controlled more accurately than the diameter of a back-etch process performed using a wet-etch or a dry-etch. Etching the substrate cavity 108 will therefore define an opening in the surface of the substrate underlying the membrane 101.

A plurality of holes, hereinafter referred to as bleed holes 111, connect the first cavity 109 and the second cavity 110.

As mentioned the membrane may be formed by depositing at least one membrane layer 101 over a first sacrificial material. In this way the material of the membrane layer(s) may extend into the supporting structure, i.e. the side walls, supporting the membrane. The membrane and back-plate layer may be formed from substantially the same material as one another, for instance both the membrane and back-plate may be formed by depositing silicon nitride layers. The membrane layer may be dimensioned to have the required flexibility whereas the back-plate may be deposited to be a thicker and therefore more rigid structure. Additionally various other material layers could be used in forming the back-plate 104 to control the properties thereof. The use of a silicon nitride material system is advantageous in many ways, although other materials may be used, for instance MEMS transducers using polysilicon membranes are known.

In some applications, the microphone may be arranged in use such that incident sound is received via the back-plate. In such instances a further plurality of holes, hereinafter referred to as acoustic holes 112, are arranged in the back-plate 104 so as to allow free movement of air molecules, such that the sound waves can enter the second cavity 110. The first and second cavities 109 and 110 in association with the substrate cavity 108 allow the membrane 101 to move in response to the sound waves entering via the acoustic holes 112 in the back-plate 104. In such instances the substrate cavity 108 is conventionally termed a "back volume", and it may be substantially sealed.

In other applications, the microphone may be arranged so that sound may be received via the substrate cavity 108 in use. In such applications the back-plate 104 is typically still provided with a plurality of holes to allow air to freely move between the second cavity and a further volume above the back-plate.

It should also be noted that whilst FIG. 1 shows the back-plate 104 being supported on the opposite side of the membrane to the substrate 105, arrangements are known where the back-plate 104 is formed closest to the substrate with the membrane layer 101 supported above it.

In use, in response to a sound wave corresponding to a pressure wave incident on the microphone, the membrane is deformed slightly from its equilibrium or quiescent position. The distance between the membrane electrode 102 and the backplate electrode 103 is correspondingly altered, giving rise to a change in capacitance between the two electrodes that is subsequently detected by electronic circuitry (not shown). The bleed holes allow the pressure in the first and second cavities to equalise over a relatively long timescale (in acoustic frequency terms) which reduces the effect of low frequency pressure variations, e.g. arising from temperature variations and the like, but without impacting on sensitivity at the desired acoustic frequencies.

The flexible membrane layer of a MEMS transducer generally comprises a thin layer of a dielectric material—such as a layer of crystalline or polycrystalline material. The membrane layer may, in practice, be formed by several layers of material which are deposited in successive steps. The flexible membrane 101 may, for example, be formed from silicon nitride $Si_3N_4$ or polysilicon. Crystalline and polycrystalline materials have high strength and low plastic deformation, both of which are highly desirable in the construction of a membrane. The membrane electrode 102 of a MEMS transducer is typically a thin layer of metal, e.g. aluminium, which is typically located in the centre of the membrane 101, i.e. that part of the membrane which displaces the most. It will be appreciated by those skilled in the art that the membrane electrode may be formed by an alloy such as aluminium-silicon for example. The membrane electrode may typically cover, for example, around 40% of area of the membrane, usually in the central region of the membrane.

Consumer electronics devices are continually getting smaller and, with advances in technology, are gaining ever-increasing performance and functionality. This is clearly evident in the technology used in consumer electronic products and especially, but not exclusively, portable products such as mobile phones, audio players, video players, PDAs, mobile computing platforms such as laptop computers or tablets and/or games devices. Requirements of the mobile phone industry for example, are driving the components to become smaller with higher functionality and reduced cost. It is therefore desirable to integrate functions of electronic circuits together and combine them with transducer devices such as microphones and speakers.

Micro-electromechanical-system (MEMS) transducers, such as MEMS microphones are finding application in many of these devices. There is therefore also a continual drive to reduce the size and cost of the MEMS devices. Furthermore, one skilled in the art will appreciate that MEMS transducers are typically formed on a wafer before being singulated. The footprint of the area required for the transducer and any associated circuitry will determine how many devices can be formed on a given wafer and, thus, impact on the cost of the MEMS device. There is therefore a general desire to reduce the footprint required for fabrication of a MEMS device on a wafer.

However, as MEMS transducer get smaller, the sensor capacitance is reduced. This leads to less signal charge and hence relatively higher electronic noise, among other effects, leading to a deterioration in performance, for example in signal-to-noise ratio.

SUMMARY

The present disclosure relates to MEMS transducers and processes which seek to alleviate some of the aforementioned disadvantages, in particular by providing a MEMS transducer that exhibits an enhanced capacitance without a corresponding increase in the footprint size of the device.

According to a first aspect there is provided a MEMS transducer comprising:

a substrate having a cavity;

a primary membrane supported relative to the substrate; and a secondary membrane provided in a plane overlying the primary membrane, wherein the secondary membrane is coupled to the primary membrane.

According to this arrangement, sound waves received via the substrate cavity may be incident on the primary membrane. The primary membrane is preferably suspended in a fixed relation relative to the substrate e.g. by its periphery being attached to the substrate and/or to the side walls of the transducer and/or another structural layer of the transducer. Thus, in response to a pressure differential arising across the primary membrane as a result of incident sound waves, the primary membrane may flex so that areas of the primary membrane away from where it is attached are displaced from its equilibrium or quiescent position.

A secondary membrane is provided in a plane overlying the primary membrane. Alternatively, a plurality of secondary membranes may be provided at successively greater distances from the primary membrane.

The, or each, secondary membrane is coupled (either directly or indirectly) to the primary membrane. Thus, according to examples in which a plurality of secondary membranes are provided, a "higher" secondary membrane may be coupled directly to the primary membrane and/or to a "lower" secondary membrane (and therefore indirectly coupled to the primary membrane) rather than directly to the primary membrane.

Preferably, the coupling between the primary and secondary membrane(s) is sufficiently rigid to ensure that the lowest resonance frequency of the whole multi-membrane structure is at least an order of magnitude higher than the highest frequency of interest for the microphone (e.g. 20 kHz).

Preferably, the secondary membrane is coupled to the primary membrane by means of a substantially rigid coupling structure. Preferably the secondary membrane is coupled to the primary membrane by means of one or more inter-planar coupling structures which extend between the secondary membrane and primary membrane. A substantially rigid coupling structure may advantageously provide a substantially fixed distance between the primary membrane and the/each secondary membrane, thus allowing the movement of the secondary membrane to follow the movement of the primary membrane. In contrast to the primary membrane, the secondary membrane is preferably not itself suspended relative to the substrate (or other structural layer of the transducer) but is mechanically coupled to the substrate only via the primary membrane. The secondary membrane can be considered to be a "drone membrane" since the movement of the secondary membrane occurs substantially as a result of the primary membrane rather than being due to any response of the secondary membrane to sound waves. Advantageously, as a result of the secondary membrane only being mechanically coupled via the primary membrane, the drone membrane does not significantly alter the stiffness or flexibility of the mounting of the membrane structure. In other words, the mechanical responsiveness to incident pressure waves of the transducer is not significantly affected as a result of the secondary membrane(s), and thus the sensitivity of the device is advantageously not compromised.

The coupling structure may, for example, comprise a conductive material such as the material used to form the transducer electrodes. Alternatively or additionally, the coupling structure may comprise a non-conductive material, such as the material that is used to form the primary and/or secondary membranes or polyimide.

According to one example a substantially rigid support plate is provided in a plane interposed between the primary and secondary membranes.

In order to form a capacitive sensing device, the rigid support plate is typically provided with one or more conductive elements which form at least one support plate electrode, the support plate electrode being one of a capacitive pair of electrodes in conjunction with another electrode—a membrane electrode—provided on the primary and/or secondary membrane. Thus, the primary membrane may be provided with one or more conductive elements forming a capacitor with one or more conductive elements associated with the rigid support plate. Similarly, the secondary membrane may be provided with one or more conductive elements forming a capacitor with one or more of the conductive elements associated with the rigid support plate.

According to examples which comprise a plurality of secondary membranes, a rigid support plate may be provided between the primary membrane and a first secondary membrane, as well as between adjacent secondary membranes.

It is typical for known MEMS transducers having a single membrane to comprise a rigid structural layer or so-called "backplate" which supports a fixed electrode and forms one of the capacitive plates of the transducer device. Thus, the substantially rigid support plate can be considered to form a similar function to the backplate of known MEMS transducer devices. However, as a consequence of the provision of two or more membranes, according to preferred examples the rigid support plate is interposed between the primary and secondary membranes. This arrangement is advantageous in that the substantially rigid support plate 104 also acts as a mechanical stop which will limit the movement of both the primary and secondary membrane. As the support plate is interposed between the primary and secondary membranes, the design allows membrane deflection to be limited in both directions, thereby protecting the transducer during e.g. a high pressure event.

It will be appreciated that the provision of a secondary membrane in a plane overlying the primary membrane significantly increases the capacitance of the transducer device per unit area. Furthermore, since the (or each) secondary membrane is only mechanically coupled via the primary membrane and is not preferably not supported in a fixed relation relative to the substrate e.g. there is no attachment of the secondary membrane at its periphery to e.g. the side-walls of the transducer—the provision of a second membrane does not significantly alter the stiffness/compliance of the transducer device. An advantage of this arrangement is that the sensitivity of the device is preferably not altered despite the provision of a plurality of membranes. It will be appreciate that the movement or actuation of the device is preferably substantially determined by the mechanical responsiveness of just the primary membrane to acoustic signals.

According to a further aspect there is provided a method of fabricating a MEMS transducer comprising:

a substrate;

a primary membrane supported relative to the substrate; and a secondary membrane provided in a plane overlying the primary membrane, wherein the secondary membrane is coupled to the primary membrane.

In the case of a capacitive microphone, for example, a cavity may be formed in the substrate and the primary membrane is formed so as to overlay the substrate cavity.

According to a further aspect there is provided a method of forming a MEMS transducer having a substrate, the method comprising:

i) forming a cavity in an upper surface of the substrate;

ii) applying a layer of polyimide to the upper surface of the substrate so as to fill the cavity;

iii) planarising the polyimide layer to give a planar surface; and iv) forming a first layer of membrane material on top of the planar surface.

The method may further comprise the steps of:

v) applying a second layer of polyimide to the layer of membrane material;

vi) planarising the second layer polyimide;

vii) forming a substantially rigid support plate on top of the planar surface.

A release etch at this stage removes the polyimide layers, and results in a single planar membrane structure having a rigid backplate which can usefully be employed in a number of MEMS transducer designs. As a consequence of the membrane being formed in-line with the upper surface of the substrate, rather than the membrane being supported from below by a plurality of pillars as is typical of known transducer structures, the resultant structure benefits from enhanced robustness, particularly to high pressure or shock events.

In order to fabricate a MEMS transducer having a primary membrane and a secondary membrane which are coupled together, the method may further comprise:

viii) applying a third layer of polyimide to cover the rigid support plate;

ix) planarising the third layer of polyimide;

x) etching through the polyimide to form a plurality of inter-planar cavities which extend to an upper surface of the layer of membrane material;

xi) depositing membrane material to form side-walls within the inter-planar cavities;

xii) filing the inter-planar cavities with polyimide and planarising; and xi) forming a second layer of membrane material on the top of the planar surface.

The transducer may be a capacitive sensor such as a microphone. The transducer may comprise readout, i.e. amplification, circuitry. The transducer may be located within a package having a sound port, i.e. an acoustic port. The transducer may be implemented in an electronic device which may be at least one of: a portable device; a battery powered device; an audio device; a computing device; a communications device; a personal media player; a mobile telephone; a tablet device; a games device; and a voice controlled device.

Features of any given aspect may be combined with the features of any other aspect and the various features described herein may be implemented in any combination in a given example.

Associated methods of fabricating a MEMS transducer are provided for each of the above aspects.

BRIEF DESCRIPTION OF THE DRAWINGS

For a better understanding of the present invention and to show how the same may be carried into effect, reference will now be made by way of example to the accompanying drawings in which.

DETAILED DESCRIPTION

Figure 1A:
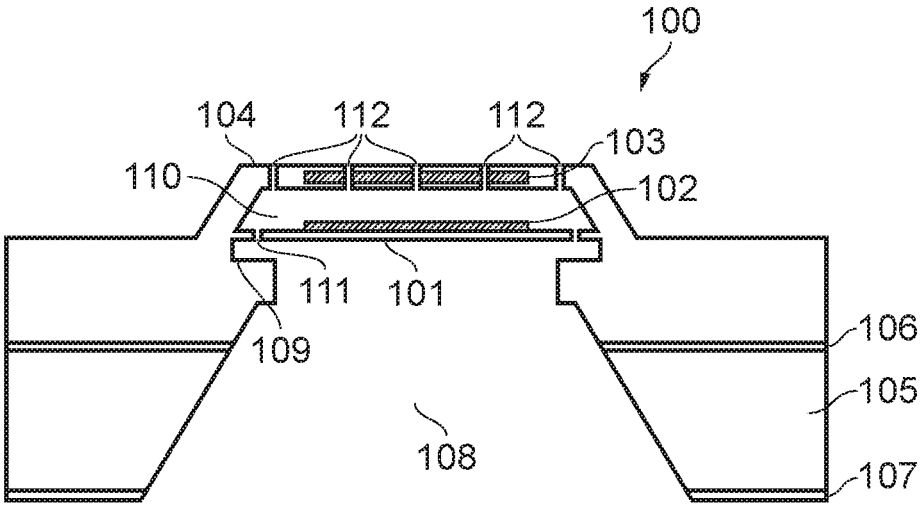
FIGS. 1*a* and 1*b* illustrate known capacitive MEMS transducers in section and perspective views.
Figure 1B:
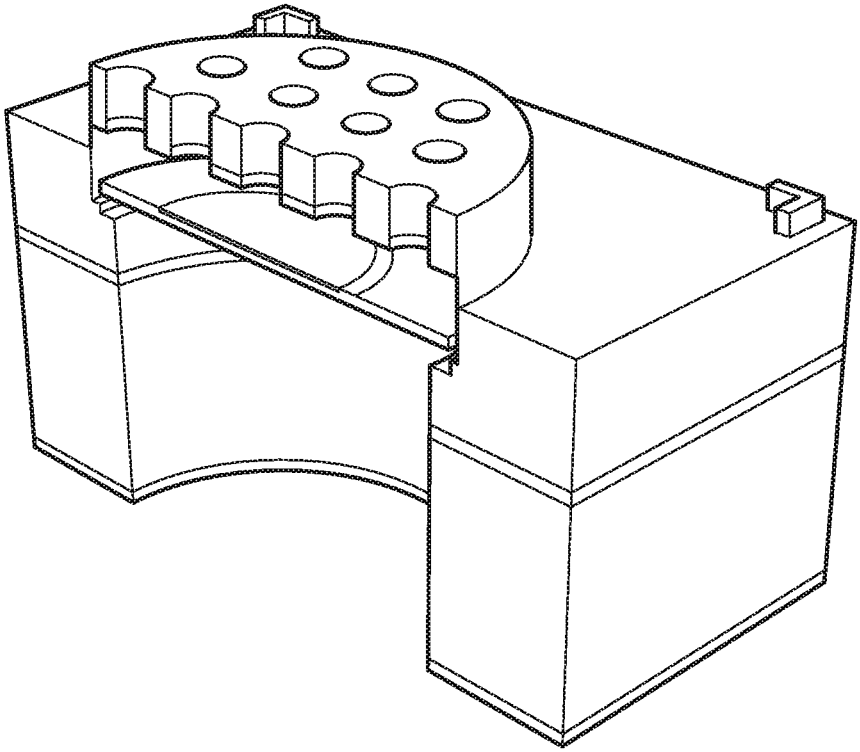

Throughout this description any features which are similar to features in other figures have been given the same reference numerals.

Examples will be described in relation to a MEMS transducer in the form of a MEMS capacitive microphone in which the primary membrane is supported in a fixed relation relative to a cavity provided in the substrate. It will be appreciated, however, that the invention is equally applicable to other types of MEMS transducer including other capacitive-type transducers.

Figure 2A:
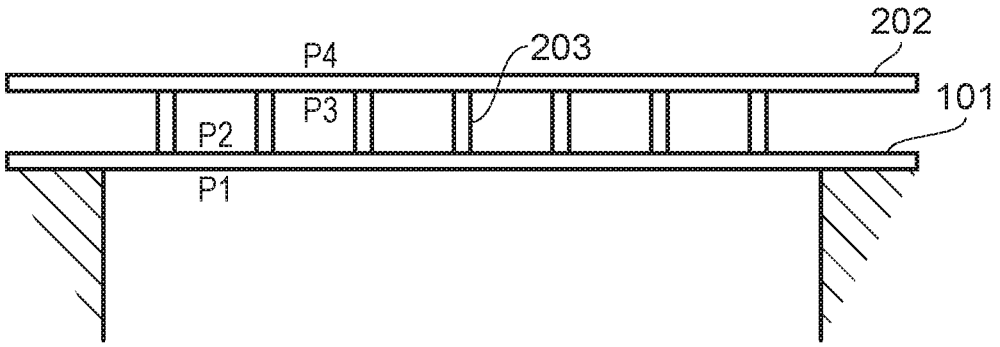
FIG. 2*a* shows a cross-sectional view of a first example structure.

FIG. 2*a* shows a cross section through an example structure comprising a primary membrane 101 that is supported at the periphery thereof relative to a substrate 105 which, in this example, has a cavity 108 formed therein. Thus, the primary membrane is suspended relative to the substrate and overlies the substrate cavity 108. The primary membrane is coupled to a secondary membrane 202 by means of a plurality of coupling structures 103. The secondary membrane 202 is provided in a plane generally parallel to the primary membrane. Cavity 108 thus forms a first acoustic volume which may be connected by means of e.g. bleed holes to a second acoustic volume above the primary membrane.

The transducer may be typically arranged to receive incident soundwaves on the lower surface of the primary membrane via the substrate cavity in use. However, in some applications the transducer may be arranged to receive incident sound waves on the secondary membrane. In either case, incident soundwaves may give rise to a pressure differential across one or both of the primary and secondary membrane. For example, an upward force on the primary membrane 101 may be given by (P1−P2)Ax, where P1 is the pressure exerted on the underside of the primary membrane, P2 is the pressure exerted on the upper side of the primary membrane and Ax is the area of the primary membrane. Similarly, an upward force on the secondary membrane 202 may be given by (P3−P4)Ay where P3 is the pressure exerted on the underside of the secondary membrane, P4 is the pressure exerted on the upper side of the secondary membrane and Ay is the area of the secondary membrane. Any net force arising on the secondary membrane will be transmitted to the primary membrane via the coupling structures 203 and be superimposed upon any net force arising on the primary membrane. Thus, assuming that Ax=Ay=A and that P2=P3 (i.e. the gap between the primary and secondary membranes is acoustically transparent), the total net upward force will be (P1−P2+P3−P4)A=(P1−P4)A.

It will be appreciated that, unlike the primary membrane, the secondary membrane is not itself suspended relative to the transducer structure. Thus, the secondary membrane is not under tension as a result of being compliantly supported in a fixed relation at its periphery. A net force arising on the secondary membrane will be transmitted to the primary membrane via the coupling structures 203 and, thus, the actual deflection of the dual membrane structure will depend on the compliance of the mounting of the primary membrane relative to the substrate of the transducer structure.

Figure 2B:
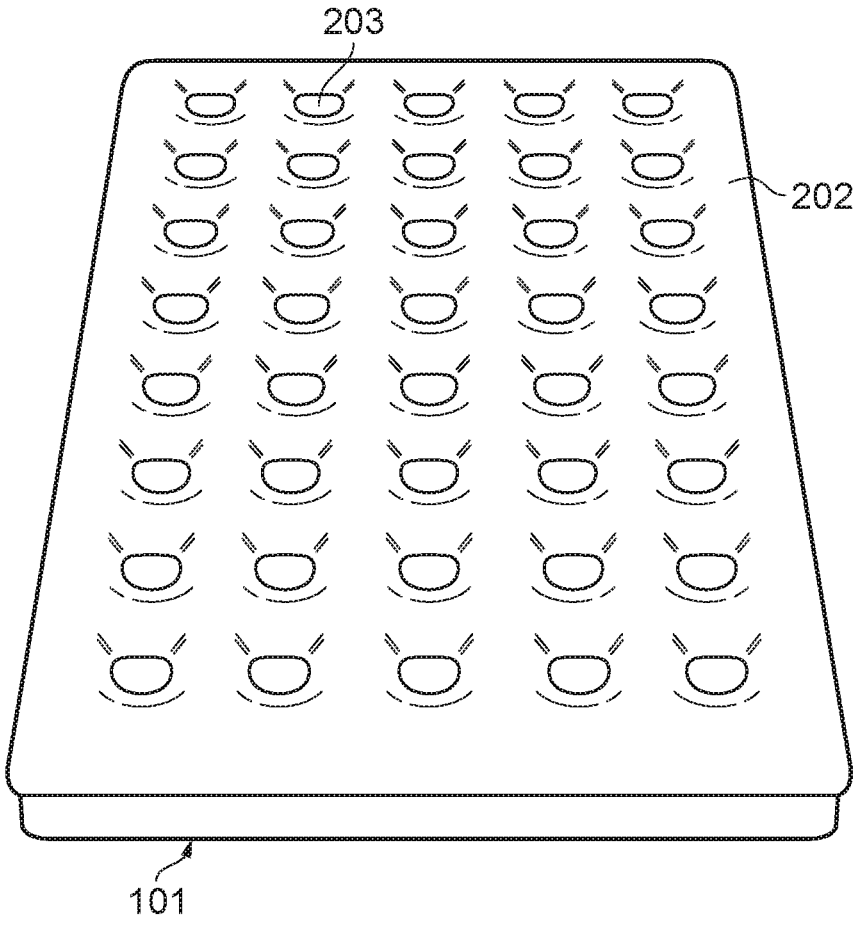
FIG. 2*b* shows a perspective elevational view of a second example structure.

FIG. 2*b* shows an elevational view of a dual membrane structure according to one example comprising a primary membrane coupled to a secondary membrane 202 by means of a plurality of coupling structures 203. For simplicity the substrate, which would support the primary membrane in a fixed relation relative thereto, is not shown.

Figure 3A:
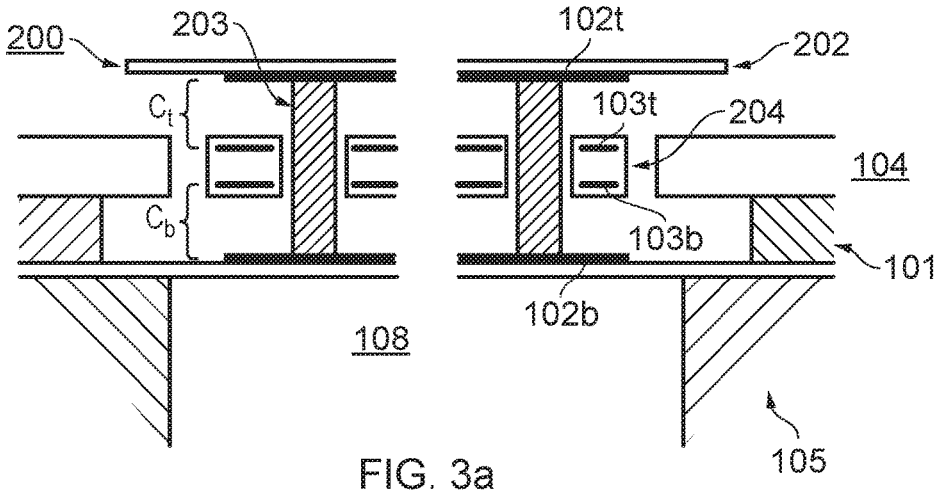
FIGS. 3*a* and 3*b* show partial cross sections through further example structures.

FIG. 3*a* shows a partial cross section through an example structure comprising a primary membrane 101 that is supported at the periphery thereof relative to a substrate 105. Thus, the primary membrane can be considered to be suspended relative to the side walls of the transducer structure so as to overlay a cavity 108 in the substrate. The primary membrane is coupled to a secondary membrane 202 by means of a plurality of coupling structures 203. The secondary membrane 202 is provided in a plane generally parallel to the primary membrane. A support plate 104 is provided which is interposed between the primary and secondary membranes. For the purposes of illustration only, FIG. 3*a* does not show the central region of the structure and just shows the periphery of the structure where the primary membrane and the support plate is supported relative to the substrate.

The support plate 104 is preferably a substantially rigid structure. One of the key functions of the support plate is to support a fixed electrode that will form a capacitive pair with an electrode provided on the primary or secondary membrane. It will be appreciated that the fixed electrode—which is typically formed of a layer of conductive material—may be deposited on the support plate or embedded within it. In a relatively simple configuration the support plate may comprise a single conductive element, or set of conductive elements, forming a single fixed electrode which forms a capacitor both with an electrode provided on the primary membrane and with an electrode provided on the secondary membrane. The support plate may be preferably acoustically transparent e.g. by providing a plurality of perforations in the support plate) to ensure that the pressure above and below the support plate are substantially equal.

Alternatively, as shown in FIG. 3*a*, the support plate may be provided with a plurality of conductive elements 103*t*, 103*b* to provide first and second electrodes. Thus, one or more conductive elements 103*t* provided in a plane closer to the secondary membrane, forms a capacitor Ct with one or more conductive elements 102*t* provided on the secondary membrane. Furthermore, one or more conductive elements 103*b* provided on the support plate in a plane closer to the primary membrane, forms a capacitor Cb with one or more conductive elements 102*b* provided on the primary membrane.

In response to an acoustic pressure wave incident on the primary membrane, and as a consequence of a pressure differential across the primary membrane 101 which is compliantly/flexibly attached to the transducer structure, the primary membrane will be displaced from its equilibrium or quiescent position. Consequently, the secondary membrane 202, which is coupled to the primary membrane, will be displaced in a similar fashion. Thus, an upward deflection of the primary membrane will give rise to the decrease in the distance between the conductive elements 102*b* and 103*b* thus leading to an increase in the capacitance Cb. The upward deflection of the primary membrane will give rise to a corresponding deflection in the secondary membrane which will lead to an increase in the distance between the conductive elements 102*t* and 103*t* thus leading to an decrease in the capacitance Ct.

Figure 3B:
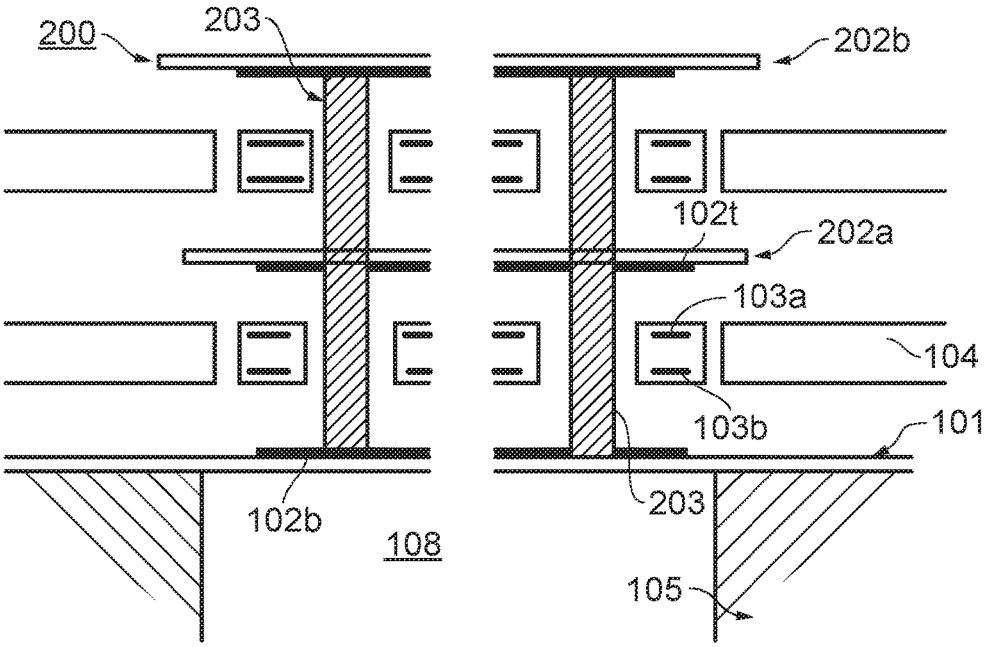

FIG. 3*b* shows a partial cross section through a further example structure comprising a primary membrane 101 that is supported at the periphery thereof relative to a substrate 105. In this example the primary membrane is coupled to two secondary membranes 202*a* and 202*b* by means of a plurality of coupling structures 203. The secondary membranes are each provided in a plane generally parallel to the primary membrane with the first secondary membrane being provided closest to the primary membrane. Each of the secondary membranes may be perforated. A first support plate 104 is provided which is interposed between the primary and secondary membranes. A second backplate is provided which is interposed between the adjacent secondary membranes 202*a* and 202*b*.

Figure 3C:
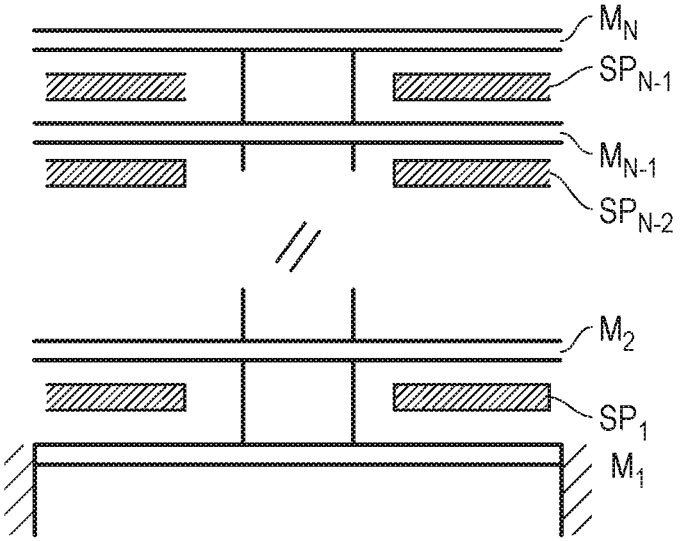
FIG. 3*c* shows a schematic illustration of an example in which a transducer is provided with N membranes.

It will be appreciated that in the case of a transducer structure having a plurality of secondary membranes, wherein adjacent secondary membranes can be considered to form a pair of secondary membranes, a rigid support plate will preferably be provided between the adjacent secondary membranes of each pair. Thus, examples are envisaged in which a transducer is provided having a number N of membranes, of which one membrane is the primary membrane M1 and N−1 membranes are secondary membranes. The transducer will also comprise N−1 support plates, each support plate being disposed between a pair of adjacent membranes. Thus, the transducer may be considered to act in the manner of a so-called comb drive actuator in which the plurality of rigid support plates provide fixed electrodes which are interspaced between a plurality of moveable membrane electrodes. In this manner, the capacitance achievable by the transducer is greatly enhanced for a given footprint area and will increase with the number of membranes N. Furthermore, since each of the secondary membranes are only coupled to the transducer structure via the primary membrane, the overall flexibility and thus sensitivity of the device is not significantly compromised. This concept is illustrated schematically in FIG. 3*c*.

It will be appreciated that there are a number of ways in which the electrodes of transducer structure having primary and secondary membranes may be electrically connected to provide an output from the two capacitors Ct and Cb, for example as illustrated in FIGS. 3*a* and 3*b*.

Figure 4A:
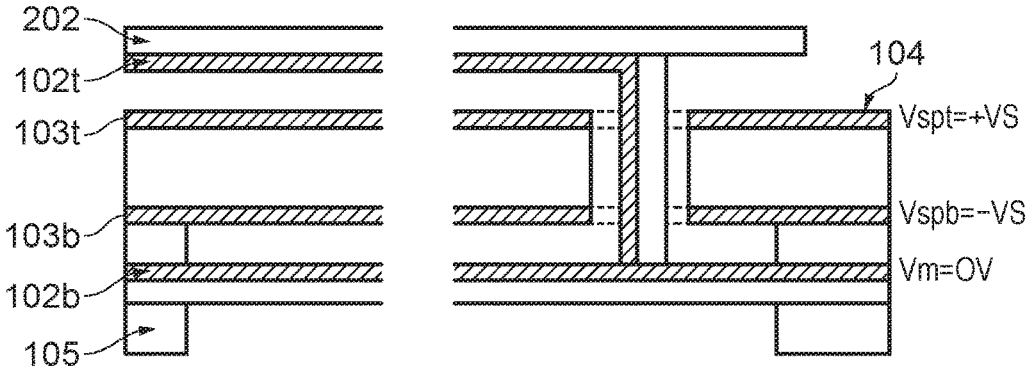
FIG. 4*a* shows the physical layout of a first electrical configuration.

FIG. 4*a* shows the physical layout of a first electrical configuration. As illustrated, two electrodes 103*t* and 103*b* are provided at the top and bottom of the support plate 104 respectively. The support plate electrodes form a top capacitor Ct with the electrode 102*t* of the secondary membrane and a bottom capacitor Cb with the electrode 102*b* of the primary membrane.

In this example the support plate electrodes 103*t* and 103*b* are electrically separate whilst the membrane electrodes 102*t* and 102*b* are connected electrically.

Figure 4B:
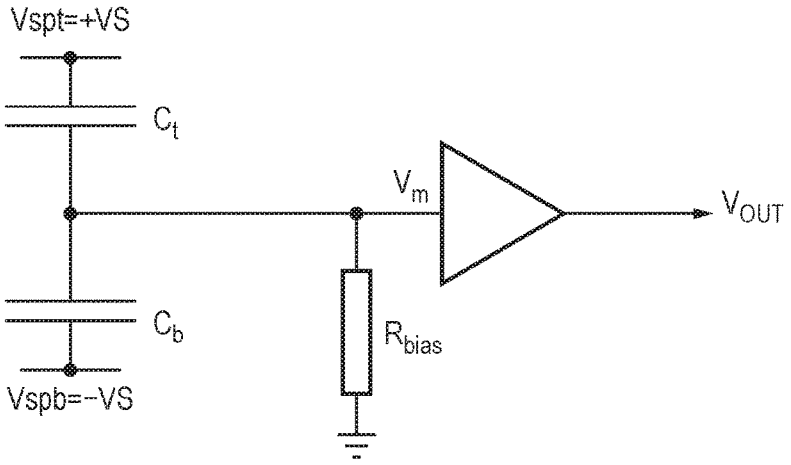
FIG. 4*b* shows an electrical schematic of the electrical configuration shown in FIG. 4*a;*

As illustrated in the associated electrical schematic shown in FIG. 4*b* in some embodiments the support plate electrodes 103*t* and 103*b* may be maintained at +VS and −VS respectively and the voltage Vm of both membrane electrodes 102*t* and 102*b* is biased at 0 V.

The readout circuit has the Ct/Cb node and thus Vm connected to its input together with a high value bias resistor, Rbias, taken to earth. The large time constant achieved with Ct, Cb, and Rbias allows Vm to be modulated at audio frequencies while establishing the d.c. bias condition of 0V.

Deflection of the membrane upwards increases the secondary membrane-to-support plate distance which decreases the top capacitor Ct. At the same time, the upward deflection decreases the primary membrane-to-support plate distance which increases the bottom capacitor Cb. To maintain constant charge, Q, an increase in the voltage across Ct is required whilst a decrease in voltage across Cb is required. The net effect is to produce a fall in the voltage Vm.

Figure 5A:
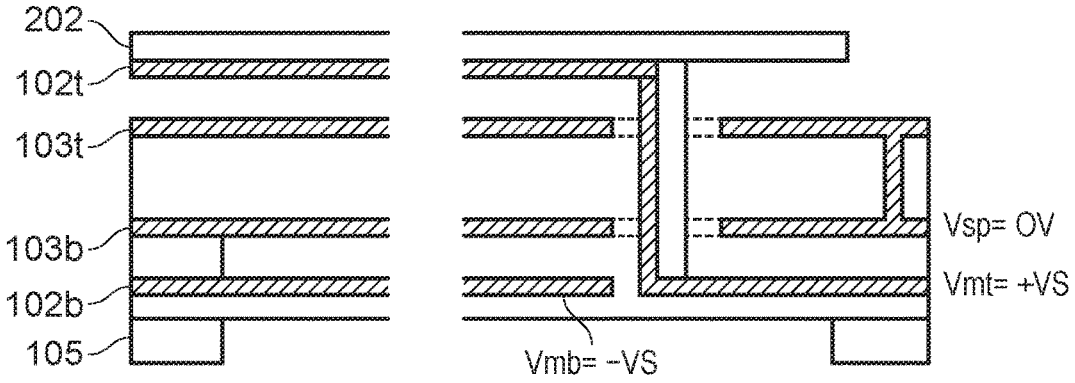
FIG. 5*a* shows the physical layout of a second electrical configuration.
Figure 5B:
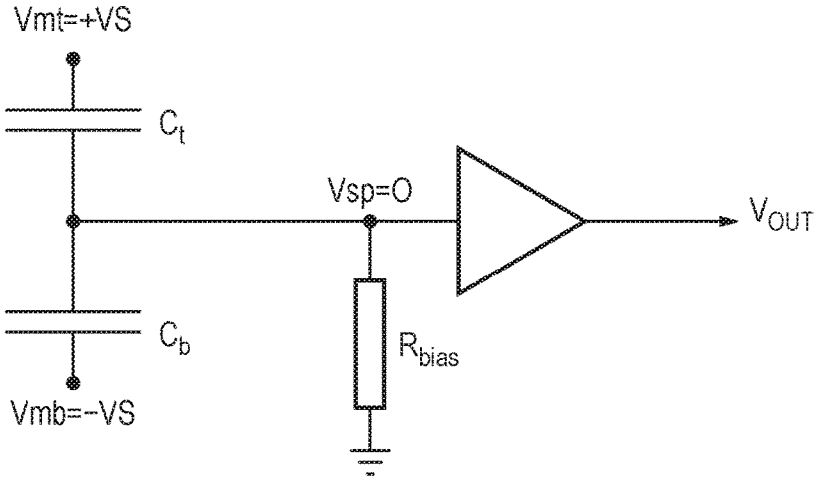
FIG. 5*b* shows an electrical schematic of the electrical configuration shown in FIG. 5*a;*

FIG. 5*a* shows the physical layout of a second electrical configuration with the associated electrical schematic shown in FIG. 5*b*.

This arrangement differs from configuration shown in FIGS. 4*a* and 4*b* in that the top and bottom of the support plate are now electrically connected such that the first and second support plate electrodes are electrically connected, whilst the primary and secondary membrane electrodes 102*b* and 102*t* are now electrically separate.

As illustrated in the associated electrical schematic shown in FIG. 5*b* in some embodiments the support plate electrodes 103*t* and 103*b* are electrically connected and are at Vsp=0 V and the membrane electrodes 102*b* and 102*t* are at Vmt=+VS and Vmb=−VS respectively.

The function of this structure is similar to that in Configuration 1, with changes in voltages across Ct and Cb still being required to support the constant charge as deflections increase Ct and decrease Cb.

The readout circuit now receives Vsp from the Ct/Cb node.

Figure 6A:
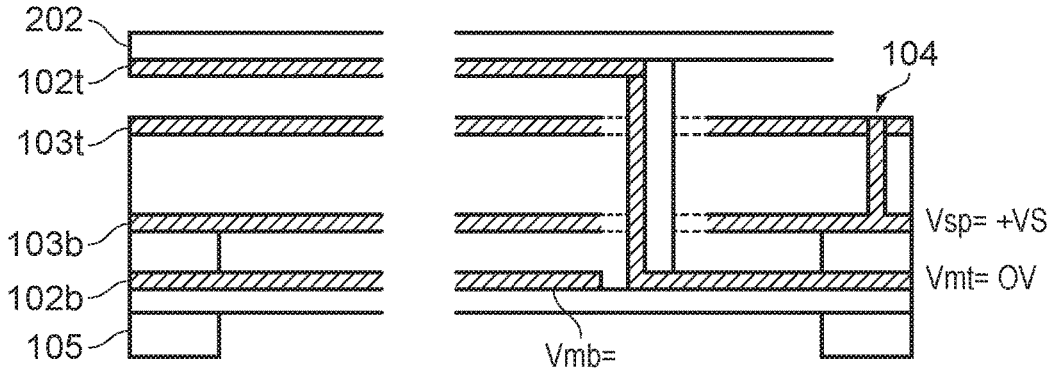
FIG. 6*a* shows the physical layout of a third electrical configuration.
Figure 6B:
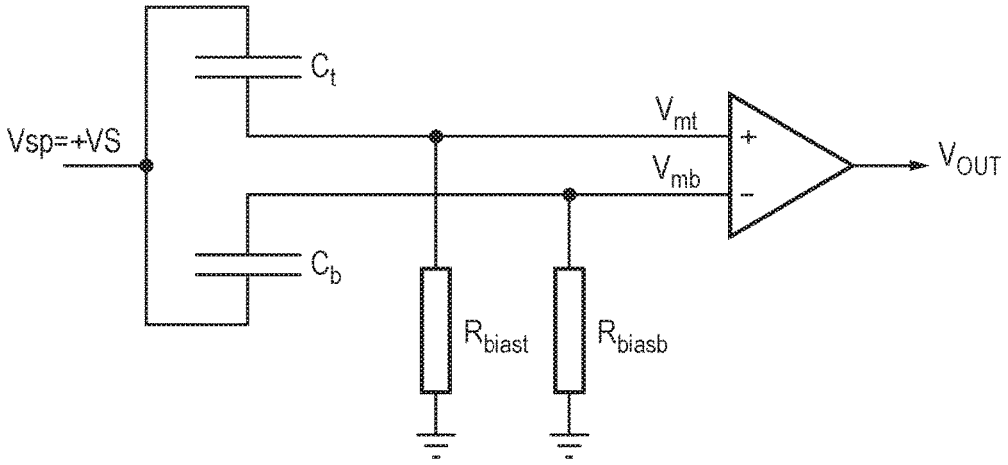
FIG. 6*b* shows an electrical schematic of the electrical configuration shown in FIG. 6*a;*

FIG. 6*a* shows the physical layout of a third electrical configuration with the associated electrical schematic shown in FIG. 6*b*.

According to this example configuration the support plate electrodes are electrically connected, but in this case the junction of Ct and Cb is held at Vsp=+VS. The other side of Ct, at Vmt, is fed to the non-inverting terminal of the differential amplifier whilst the other side of Cb, at Vmb, goes to the inverting terminal of the differential amplifier. Bias resistors are connected to bias the non-inverting and inverting terminals of the differential amplifier to ground or some other convenient reference voltage.

In operation, deflections of the membranes and associated electrodes 102 and 103 will lead to changes of Vmt and Vmb, which constitutes a differential signal which will be amplified by the differential amplifier. Common mode signals and noise, which may be fed into the sense lines, will be attenuated or rejected by the action of the differential amplifier, depending on the common mode rejection ratio (CMRR) of the amplifier.

This structure allows the use of a differential amplifier as the readout circuit, which benefits from its ability to attenuate or reject common mode noise. As will be appreciated, differential systems are advantageous in that they allow electrical noise generated from sources such as the transducer power supply or noise picked up from external electrical interference to be removed by e.g. common mode rejection whereby the two output signals generated from the respective changes in capacitance are applied to both inputs of differential amplifier and subtracted.

According to other aspects methods are provided for fabricating a MEMS transducer. FIGS. 7*a* to 7*g* illustrate a sequence of steps for forming a single membrane transducer having a rigid support plate.

Figure 7A:
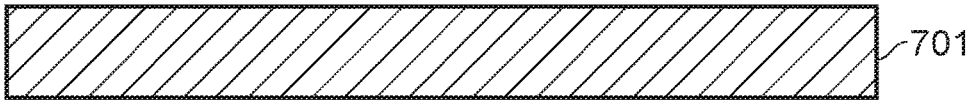
FIGS. 7*a* to 7*g* illustrate a sequence of steps for forming a single membrane transducer.
Figure 7B:
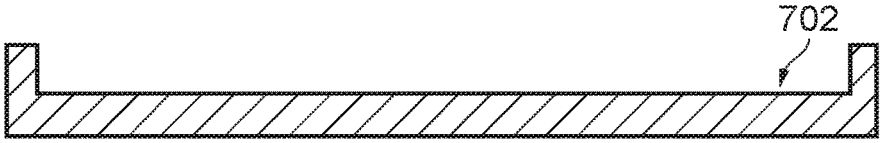
Figure 7C:
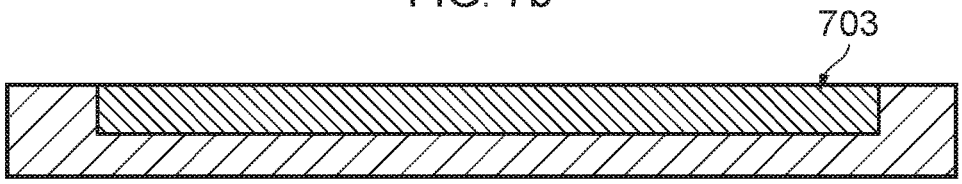

As shown in FIG. 7*a* a silicon wafer 701 is provided which will form the substrate of the intended transducer device. A silicon etch is performed to form a cavity 702 in the substrate as shown in FIG. 7*b*. A sacrificial layer of polyimide 703 is applied and the structure is then planarised to give a structure as shown in FIG. 7*c* having a desired planar surface. It will be appreciated that in contrast to previously considered techniques in which the substrate cavity is typically formed by etching through the underside of the cavity, the substrate cavity according to this method has been defined from the upper side of the silicon wafer. This technique alleviates the need to account for alignment of the etch hole through the underside of the cavity with the with the intended overlying membrane layer.

Figure 7D:
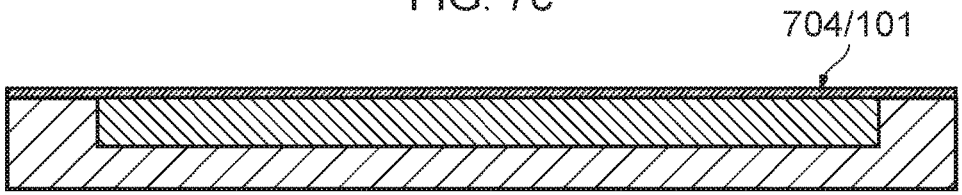

A layer of silicon nitride 704 is then deposited on the planar surface and etched to the required thickness to give a structure as shown in FIG. 7*d*. The silicon nitride layer will form a primary membrane 101 or the single membrane of the eventual MEMS transducer.

Figure 7E:
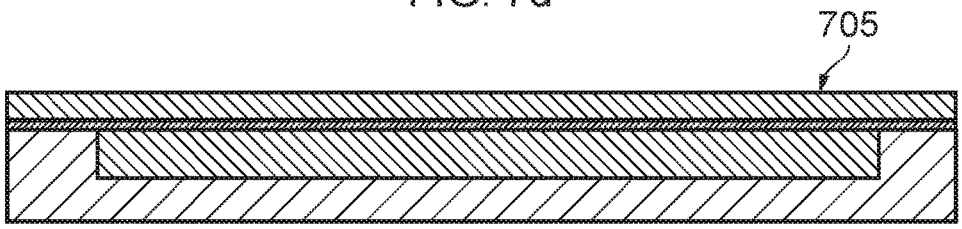
Figure 7F:
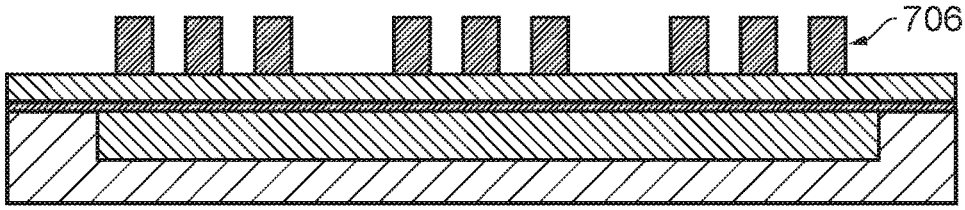
Figure 7G:
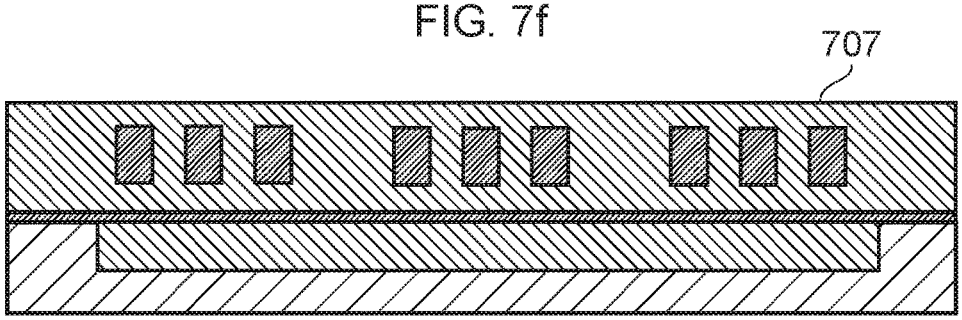

In FIG. 7*e* a further coat 705 of polyimide has been applied and the upper surface once again planarised. A number of layers of silicon nitride are deposited on the planarised surface and are patterned as required to form a substantially rigid support plate or backplate 706 as shown in FIG. 7*f*. FIG. 7*g* shows a further layer of polyimide 707 applied to encapsulate the SiN support plate. A release etch at this stage to remove the polyimide layers will result in a single planar membrane structure having a rigid backplate which can usefully be employed in a number of MEMS transducer designs. As a consequence of the membrane being formed in-line with the upper surface of the substrate, rather than the membrane being supported from below by a plurality of pillars as is typical of known transducer structures, the resultant structure benefits from enhanced robustness, particularly to high pressure or shock events.

Figure 7H:
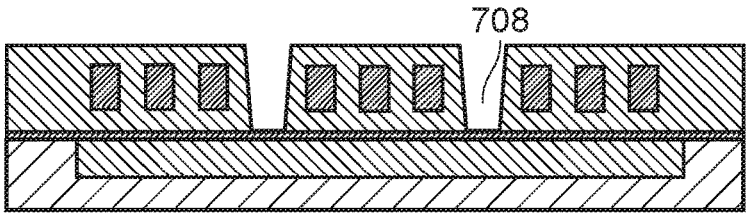
FIGS. 7*h* to 7*n* illustrate a further sequence of steps for forming a dual membrane transducer.

In order to fabricate a MEMs transducer having a primary membrane and a secondary membrane which are coupled together, the structures shown in FIG. 7*g* is further processed. As shown in FIG. 7*h* the polyimide coating is etched down to the upper surface of the membrane layer—which will form the primary membrane—to form a plurality of inter-planar channels 708 having side walls. The inter-planar channels will ultimately facilitate the formation the coupling structure for coupling the eventual primary and secondary membranes of the transducer.

Figure 7I:
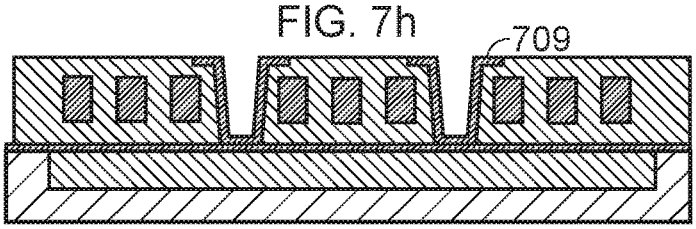
Figure 7J:
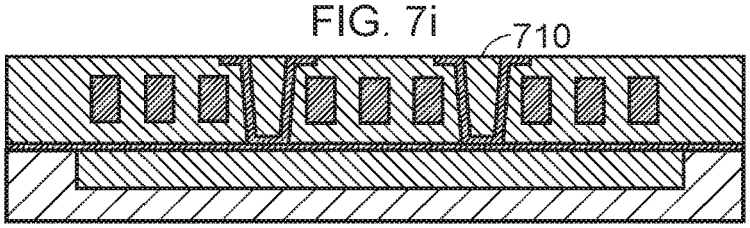
Figure 7K:
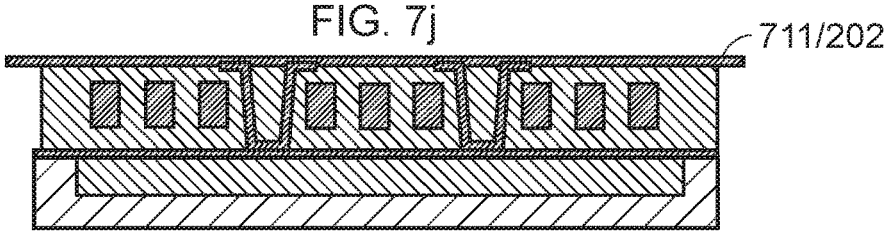

Silicon Nitride 709 is deposited within the channels resulting in the structure shown in FIG. 7*i*, and a further coat of polyimide 710 is deposited to fill the channels is applied. The upper surface of the polyimide coating is planarised to give a planar surface in line with the top of the inter-planar channels as shown in FIG. 7*j*. A second membrane layer 711/202 is then deposited on the planar surface to give the structure as shown in FIG. 7*k*.

Figure 7L:
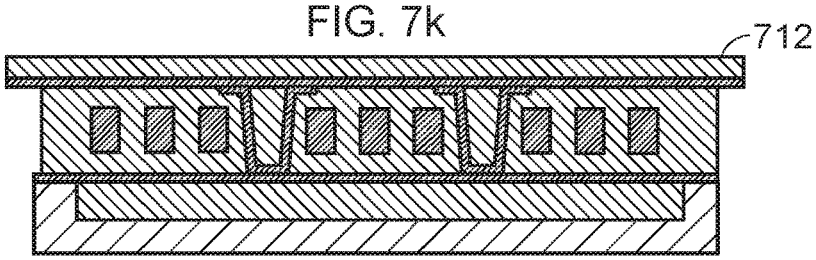
Figure 7M:
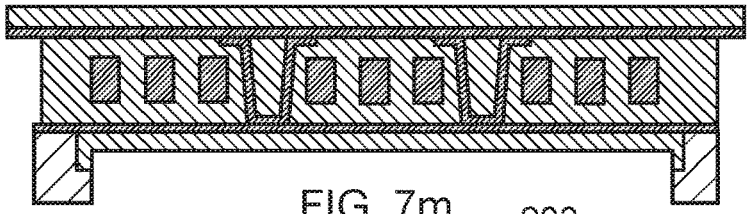
Figure 7N:
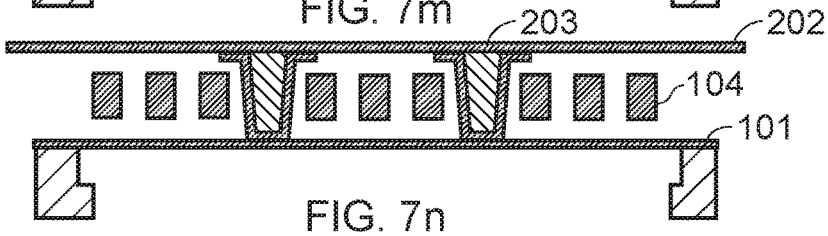
Figure 8:
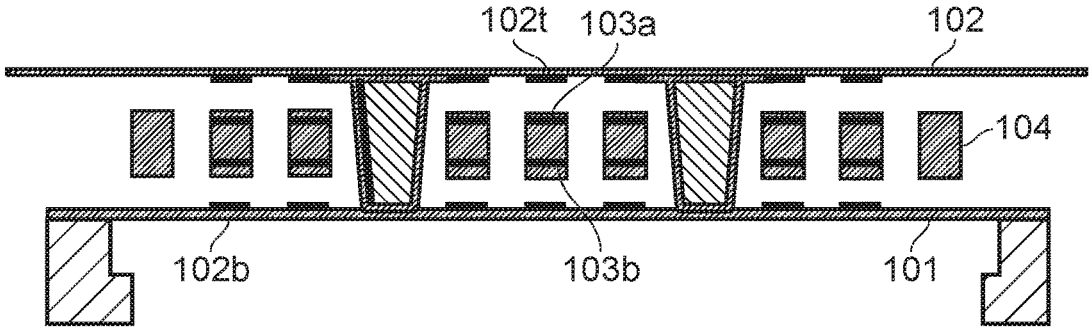
FIG. 8 illustrates a further example of a transducer structure.

As shown in FIG. 7*l* and in order to protect the structure during subsequent processing on the underside of the substrate, a further coat of polyimide 712 is applied. Then, as shown in FIG. 7*m*, a backside etch is conducted through the silicon waver through to the polyimide layer. Finally, a polyimide etch is performed to release the structure shown in FIG. 7*n* having a primary membrane 101 suspended with respect to the substrate and a secondary membrane 202 that is rigidly coupled to the primary membrane by means of coupling structures 203. The substantially rigid support plate 104 incorporates one or more conductive layers (omitted from the sequence of process steps for simplicity) which form the support plate electrodes 103*a* and 103*b* as shown in FIG. 8. The polyimide fill within the inter-planar channels may be left to provide enhanced structure support and/or rigidity to the coupling structure 203, or removed as desired.

Figure 9:
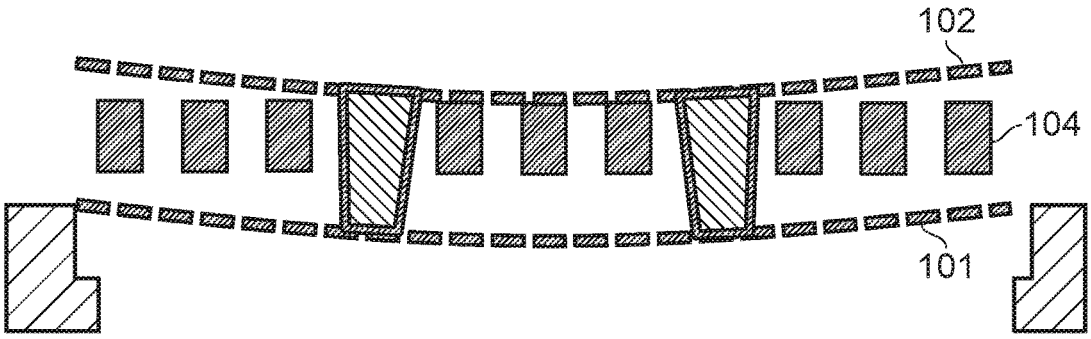
FIG. 9 shows the deflection of the transducer structure in FIG. 8.

The substantially rigid support plate 104 also acts as a mechanical stop in order to limit the movement of both the primary and secondary membrane. As the support plate is interposed between the primary and secondary membranes, the design allows membrane deflection to be limited in both directions, thereby protecting the transducer during e.g. a high pressure event. This is illustrated in FIG. 9.

The primary and secondary membrane may, for example, be formed from silicon nitride $Si_3N_4$ or polysilicon. Crystalline and polycrystalline materials have high strength and low plastic deformation, both of which are highly desirable in the construction of a membrane. The conductive electrodes of the support plate and/or of the membrane may be formed of a conductive dielectric such as titanium nitride, polysilicon, silicon carbide, amorphous silicon or tantalum nitride or a metal, such as aluminium, or a metal-alloy aluminium-silicon alloy.

The rigid support plate may typically be formed of the same material as the membrane, although provided as a thicker layer or deposited a plurality of layers, in order to impart the required structural rigidity. Thus, the rigid support plate may be formed of silicon nitride $Si_3N_4$ or polycrystalline silicon. Those skilled in the art will appreciate that polysilicon may be doped locally or globally to form a conductive region. Thus, embodiments are envisaged in which the membrane and/or support plate are formed of polysilicon and wherein a region of the polysilicon is doped to form a conductive electrode region. Thus, in such an example, there is no specific layer of electrode material on the surface of the membrane and/or on or within the support plate. Rather the electrode is formed from a doped region of the polysilicon that forms the membrane and/or support plate.

A MEMS transducer according to the examples described here may comprise a capacitive sensor, for example a microphone.

A MEMS transducer according to the examples described here may further comprise readout circuitry, for example wherein the readout circuitry may comprise analogue and/or digital circuitry such as a low-noise amplifier, voltage reference and charge pump for providing higher-voltage bias, analogue-to-digital conversion or output digital interface or more complex analogue or digital signal processing. There may thus be provided an integrated circuit comprising a MEMS transducer as described in any of the examples herein.

One or more MEMS transducers according to the examples described here may be located within a package. This package may have one or more sound ports. A MEMS transducer according to the examples described here may be located within a package together with a separate integrated circuit comprising readout circuitry which may comprise analogue and/or digital circuitry such as a low-noise amplifier, voltage reference and charge pump for providing higher-voltage bias, analogue-to-digital conversion or output digital interface or more complex analogue or digital signal processing.

A MEMS transducer according to the examples described here may be located within a package having a sound port.

According to another aspect, there is provided an electronic device comprising a MEMS transducer according to any of the examples described herein. An electronic device may comprise, for example, at least one of: a portable device; a battery powered device; an audio device; a computing device; a communications device; a personal media player; a mobile telephone; a games device; and a voice controlled device.

According to another aspect, there is provided a method of fabricating a MEMS transducer as described in any of the examples herein.

Although the various examples describe a MEMS capacitive microphone, the examples described herein are also applicable to any form of MEMS transducers other than microphones, for example pressure sensors or ultrasonic transmitters/receivers.

Examples may be usefully implemented in a range of different material systems, however the examples described herein are particularly advantageous for MEMS transducers having membrane layers comprising silicon nitride.

In the examples described above it is noted that references to a transducer element may comprise various forms of transducer element. For example, a transducer element may comprise a single membrane and back-plate combination. In another example a transducer element comprises a plurality of individual transducers, for example multiple membrane/back-plate combinations. The individual transducers of a transducer element may be similar, or configured differently such that they respond to acoustic signals differently, e.g. the elements may have different sensitivities. A transducer element may also comprise different individual transducers positioned to receive acoustic signals from different acoustic channels.

It is noted that in the examples described herein a transducer element may comprise, for example, a microphone device comprising one or more membranes with electrodes for read-out/drive deposited on the membranes and/or a substrate or back-plate. In the case of MEMS pressure sensors and microphones, the electrical output signal may be obtained by measuring a signal related to the capacitance between the electrodes. However, it is noted that the examples are also intended to embrace the output signal being derived by monitoring piezo-resistive or piezo-electric elements or indeed a light source. The examples are also intended embrace a transducer element being a capacitive output transducer, wherein a membrane is moved by electrostatic forces generated by varying a potential difference applied across the electrodes.

It is noted that the examples described above may be used in a range of devices, including, but not limited to: analogue microphones, digital microphones, pressure sensor or ultrasonic transducers. The invention may also be used in a number of applications, including, but not limited to, consumer applications, medical applications, industrial applications and automotive applications. For example, typical consumer applications include portable audio players, wearable devices, laptops, mobile phones, PDAs and personal computers. Examples may also be used in voice activated or voice controlled devices. Typical medical applications include hearing aids. Typical industrial applications include active noise cancellation. Typical automotive applications include hands-free sets, acoustic crash sensors and active noise cancellation.

It should be understood that the various relative terms upper, lower, top, bottom, underside, overlying, beneath, etc. that are used in the present description should not be in any way construed as limiting to any particular orientation of the transducer during any fabrication step and/or it orientation in any package, or indeed the orientation of the package in any apparatus. Thus the relative terms shall be construed accordingly.

It should be noted that the above-mentioned examples illustrate rather than limit the invention, and that those skilled in the art will be able to design many alternative examples without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference signs in the claims shall not be construed so as to limit their scope.

The invention claimed is:

1. A MEMS transducer comprising:

a substrate comprising a cavity;

a primary membrane, wherein the periphery of the primary membrane is supported in a fixed relation relative to the substrate so as to overlie the cavity;

at least one secondary membrane provided in a plane overlying the primary membrane, wherein the secondary membrane is mechanically coupled to the primary membrane and wherein the periphery of the secondary membrane is not supported in a fixed relation relative to the substrate.

2. A MEMS transducer as claimed in claim 1, wherein the secondary membrane is coupled to the primary membrane by means of a substantially rigid coupling structure.

3. A MEMS transducer as claimed in claim 1, wherein the secondary membrane is coupled to the primary membrane by means of one or more coupling structures which extend between the secondary membrane and the primary membrane.

4. A MEMS transducer as claimed in claim 1 further comprising a support structure interposed between the primary membrane and the secondary membrane.

5. A MEMS transducer as claimed in claim 4, wherein the support structure is perforated to include a plurality of holes which extend from the upper surface of the support structure to the lower surface of the support structure.

6. A MEMS transducer as claimed in claim 4, wherein the support structure comprises one or more conductive elements which form at least one support plate electrode, each support plate electrode forming a capacitor with a membrane electrode of the primary or the secondary membrane.

7. A MEMS transducer as claimed in claim 1, wherein a first support plate electrode forms a bottom capacitor with at least one electrode of the primary membrane and wherein a second support plate electrode forms a top capacitor with at least one electrode of the secondary membrane.

8. A MEMS transducer as claimed in claim 7, wherein the first and second support plate electrodes are electrically separate and wherein the primary membrane electrode is electrically connected to the secondary membrane electrode.

9. A MEMS transducer as claimed in claim 8, wherein the voltage of the first and second support plate electrodes are held at +Vs and −Vs respectively and wherein the voltage Vm of the primary and secondary membrane electrodes is biased at 0V.

10. A MEMS transducer as claimed in claim 6, wherein the first and second support plate electrodes are electrically connected to each other and wherein the membrane electrodes of the primary and secondary membranes are electrically separate.

11. A MEMS transducer as claimed in claim 10, wherein the voltage of the support plate electrodes is biased at 0V and the voltage of the primary and secondary membranes are held at +Vs and −Vs respectively.

12. A MEMS transducer as claimed in claim 10, wherein the membrane electrodes of the primary and secondary membranes are connected to respective positive and negative inputs of a differential amplifier.

13. A MEMS transducer as claimed in claim 1, wherein said primary and/or secondary membrane comprises a crystalline or polycrystalline material such as silicon nitride.

14. A MEMS transducer as claimed in claim 1, wherein the electrode is formed of aluminium and/or aluminium-silicon alloy and/or titanium nitride.

15. A MEMS transducer as claimed in claim 1, wherein the secondary membrane is perforated.

16. A MEMS transducer as claimed in claim 1, wherein the secondary membrane is not supported in a fixed relation relative to the substrate.

17. A MEMS transducer as claimed in claim 1, wherein the secondary electrode is mechanically coupled to the substrate only via the primary membrane.

18. A MEMS transducer as claimed in claim 1 wherein said transducer comprises a capacitive sensor such as a capacitive microphone.

19. An electronic device comprising a MEMS transducer as claimed in claim 1, wherein said device is at least one of: a portable device; a battery powered device; an audio device; a computing device; a communications device; a personal media player; a mobile telephone; a games device; and a voice controlled device.

20. A MEMS transducer comprising:

a substrate;

a primary membrane supported in a fixed relation relative to the substrate;

at least one secondary membrane provided in a plane overlying the primary membrane, wherein the secondary membrane is mechanically coupled to the primary membrane and is only indirectly supported relative to the substrate via the primary membrane.

21. A MEMS transducer comprising:

a substrate;

a primary membrane supported in a fixed relation relative to the substrate;

at least one secondary membrane provided in a plane overlying the primary membrane, wherein the secondary membrane is mechanically coupled to the primary membrane and is mechanically coupled to the substrate only via the primary membrane.

* * * * *